United States Patent [19]
Allen
[11] 4,407,097
[45] Oct. 4, 1983

[54] RAIN GUTTER CONSTRUCTION

[76] Inventor: Jack H. Allen, 223 SE. 122nd Ave., Portland, Oreg. 97233

[21] Appl. No.: 122,072

[22] Filed: Feb. 15, 1980

[51] Int. Cl.³ ..... E04D 13/00
[52] U.S. Cl. ..... 52/11
[58] Field of Search ..... 52/11, 16, 12, 13–15; 405/119, 40, 41

[56] References Cited

U.S. PATENT DOCUMENTS

| | | | |
|---|---|---|---|
| 190,382 | 5/1877 | Snyder | 52/11 |
| 1,373,883 | 4/1921 | Gray | 405/119 |
| 2,003,730 | 6/1935 | Baldwin | 405/119 |
| 2,461,610 | 2/1949 | Lord | 52/12 |
| 2,737,778 | 3/1956 | Wold | 405/119 |
| 3,507,078 | 4/1970 | Sayers | 52/15 |
| 3,508,405 | 4/1970 | Koch | 405/119 |
| 3,664,071 | 5/1972 | Gallagher | 405/119 |
| 3,783,564 | 1/1974 | Dunn | 52/74 |
| 4,142,370 | 3/1979 | Giordano | 52/11 |

FOREIGN PATENT DOCUMENTS

| | | | |
|---|---|---|---|
| 39483 | 5/1909 | Austria | 52/16 |
| 54-149017 | 11/1979 | Japan | 52/16 |

*Primary Examiner*—John E. Murtagh
*Assistant Examiner*—Henry E. Raduazo
*Attorney, Agent, or Firm*—Schapp and Hatch

[57] ABSTRACT

A rain gutter construction permitting water jets and prodding rods to be inserted through the ends of straight sections of the rain gutter. In one embodiment, a hinged door replaces the end of the gutter and is releasably held closed by latch means. In another embodiment, an outside corner portion of the gutter is eliminated and replaced with a hinged section, also releasably held closed by latch means.

13 Claims, 11 Drawing Figures

RAIN GUTTER CONSTRUCTION

BACKGROUND OF THE INVENTION

1. Field of the Invention

The present invention relates to a RAIN GUTTER CONSTRUCTION, and more particularly to devices for facilitating cleaning of rain gutters.

2. Description of the Prior Art

As every house owner knows, leaves and other debris often accumulate in rain gutters, causing unsightly overflows and/or premature rusting of metal gutters. Since the rain gutters run along the eaves at relatively high elevations, climbing on ladders to remove the debris from the rain gutters in the usual way is quite dangerous and has resulted in many accidents.

Attempts have been made to provide for cleaning out rain gutters from remote locations. One such approach is shown in U.S. Pat. No. 3,507,078 to H. D. Sayers, Sr. wherein the entire gutter is hinged so it can be lifted up and turned upside down for cleaning. This approach involves expensive structural modifications and requires frequent repairs.

Another known approach to the remote cleaning out of rain gutters is set forth in U.S. Pat. No. 2,887,073 to W. G. Thompson wherein the gutter is provided with a conduit for spraying water into the gutter to dislodge debris, together with a downspout attachment for collecting the dislodged debris. A similar type of downspout device for collecting leaves and other debris is shown in U.S. Pat. No. 3,628,668 to M. Huppert. Such devices are quite complicated, require extensive modification of the gutter drain structures, and are not always effective.

SUMMARY OF THE INVENTION

Applicant has recognized that effective cleaning of the gutters can best be accomplished by making provision for directing a jet of water from a garden hose nozzle along the length of the straight stretches of rain gutter, and by prodding compacted leaves, etc., which cannot be removed by the jet of water, this prodding being accomplished by an elongated member lying substantially parallel to the bottom of the rain gutter trough.

In the present invention, the rain gutters are formed to permit insertion of the garden hose nozzle and/or the elongated prodding tool through what would normally be the portions of the trough walls aligned with the straight stretches, such trough wall portions being formed for selective movement between a first position normally forming part of the gutter and a second position permitting the described access to the interior of the straight length of gutter. This permits the user to swing the described portions of the trough wall out of the way for the aforesaid prodding and water jet cleaning actions.

Accordingly, it is an object of the present invention to provide a rain gutter construction capable of being cleaned along the lengths of the straight sections thereof by prodding and/or water jet action from an end of such straight section.

Another object of the present invention is to provide an apparatus of the character described which is simple and sturdy in design and which is unobtrusive when not in use.

A further object of the present invention is to provide a structure of the character set forth which is incorporated into the rain gutters, has no removable parts, does not impede the normal interior character of the trough and is adapted for insertion into existing structures.

A still further object of the present invention is to provide an apparatus of the character described which may be manipulated from a distance so as to avoid the necessity for climbing on ladders while effecting cleaning operations.

In accordance with a principal feature of the present invention, the end wall at the end of a straight stretch of rain gutter trough is mounted for selective movement between its normal position closing off the end of the trough and a retracted position permitting insertion of cleaning tools through the trough end.

In accordance with another principal feature of the present invention, portions of the rain gutter trough outer side walls at an outside corner of the trough are selectively movable between their normal position completing the trough corner and a retracted position permitting insertion of cleaning tools into the straight stretches of trough proceeding from such corner.

In accordance with another principal feature of the present invention, the described trough end walls and portions of the outside wall at outside corners are carried by hinges which are unobtrusive, weatherproof and which do not require lubrication or other servicing throughout a long operating life.

For a fuller understanding of the various objects and features of the present invention, reference should be had to the following detailed description, taken in connection with the accompanying drawings.

Figure 1:
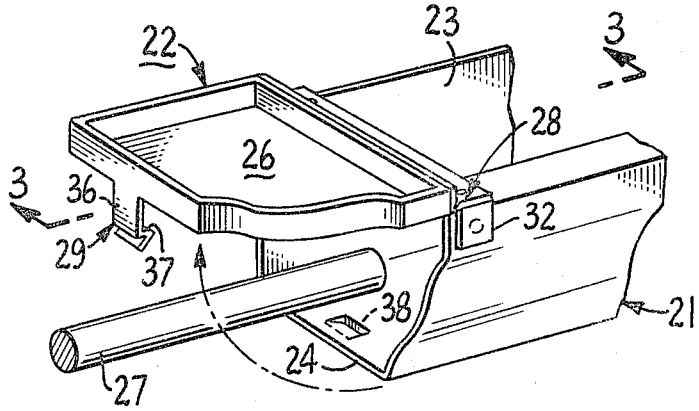
FIG. 1 is a fragmentary perspective view of the end of a rain gutter trough having a device constructed in accordance with the present invention mounted in operative association thereon, the end wall of the trough being shown swung aside for insertion of cleaning tools into the trough end.

While only certain preferred embodiments of the invention have been illustrated in the drawings, it should be apparent that other embodiments and modifications may be made without departing from the spirit and scope of the invention as set forth in the claims.

DESCRIPTION OF THE PREFERRED EMBODIMENTS

The rain gutter construction of the present invention includes a straight length of rain gutter trough 21 and means 22 providing access to the interior 23 of the straight length of gutter from an end 24 thereof. Means 22 comprises a member or members 26 mounted for selective movement between a first position forming part of the gutter and a second position permitting access to the interior 23 of the straight length of gutter 21 by an elongated cleaning tool such as rod 27, the end of which is illustrated in FIG. 1. The second, retracted position of member 26 also permits insertion of a garden hose nozzle (not shown) into the end 24 of the trough so that a jet of water therefrom can be directed down the length of the trough.

In the forms of the invention illustrated in the drawings, the member 26 is mounted to the gutter 21 by hinge means 28 for swinging movement between the described closed and open positions, and latch means 29 as provided for releasably securing the member 26 in closed position.

In accordance with the present invention, the hinge means 22 preferably is in the form of a unitary polypropylene hinge. These hinges have been found to be extremely long wearing and are relatively chemically inert to materials likely to be found in a rain trough, thus making them substantially waterproof. The polypropylene hinges are attached in place by suitable known adhesives or by screws 31.

Figure 2:
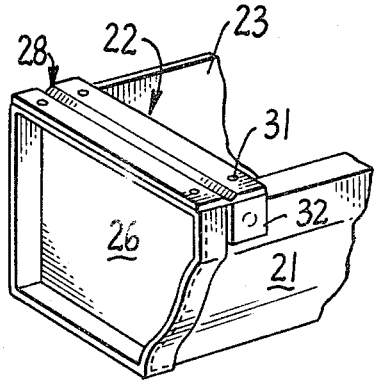
FIG. 2 is a view taken similarly to that of FIG. 1, but showing the end wall in closed, normal position.
Figure 3:
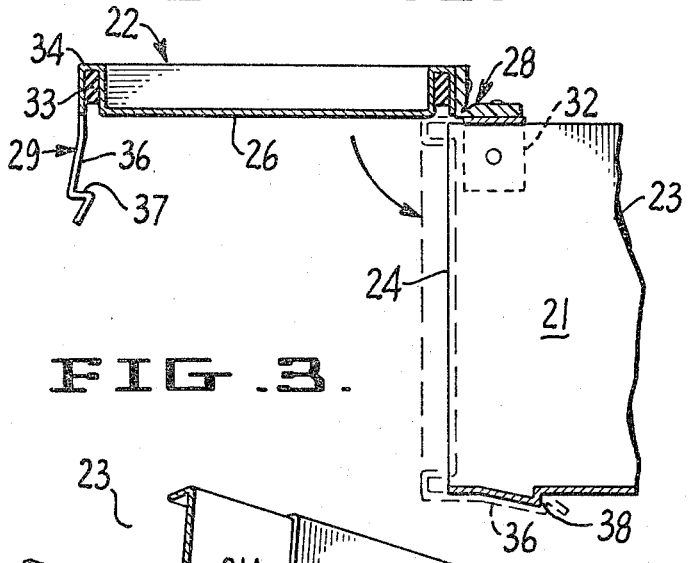
FIG. 3 is a vertical cross-sectional view on an enlarged scale taken substantially on the plane of line 3—3 of FIG. 1.

As illustrated in FIGS. 1 through 3 of the drawings, the member 26 conforms to the shape of the end of a straight run of the trough 21. A hinge 28 is secured to member 26 and to a bracket member 32 mounted across the top of gutter trough end 24. Hinge 28 runs along bracket 32 and is secured to the upper edge of member 26 so that member 26 is swingable between a position closing off the end 24 of trough 21 and the raised position illustrated in FIGS. 1 and 3 of the drawings. In the raised or retracted position, member 26 permits insertion of cleaning tool 27 or a hose nozzle into the end 24 of trough 21.

As here shown, a gasket 33 is mounted in a U-shaped channel 34 formed around the periphery of member 26, with the gasket 33 being adapted to engage against the trough end 24 to prevent leakage between the trough end 24 and the closure member 26 when the ladder is in its closed position.

Latch means 29 here includes a resilient ear 36 extending from member 26 and bent as illustrated in FIGS. 1 and 3 of the drawings to provide a shoulder 37 adapted to snap over a shoulder 38 at the bottom of trough 21, see FIG. 3.

Figure 4:
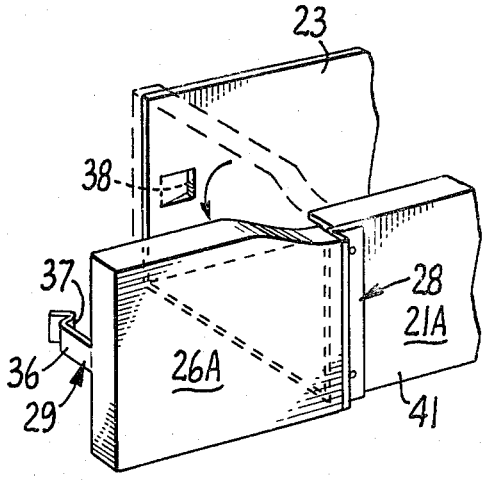
FIG. 4 is a view taken similarly to that of FIG. 1, but illustrating a trough shaped differently than that of FIGS. 1 through 3, together with a closure therefore constructed in accordance with the present invention.
Figure 5:
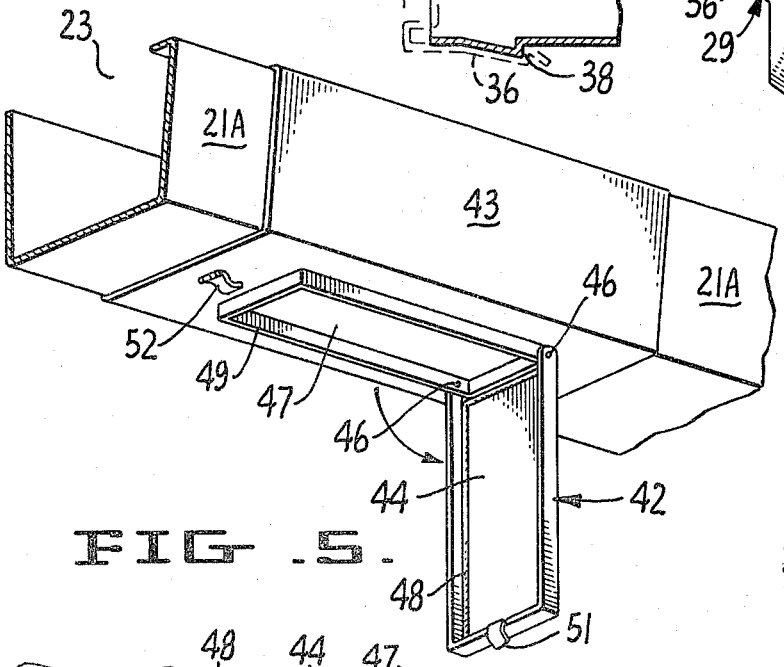
FIG. 5 is a fragmentary perspective view of a portion of a rain gutter trough having an open trap door formed in accordance with the present invention mounted therein.
Figure 6:
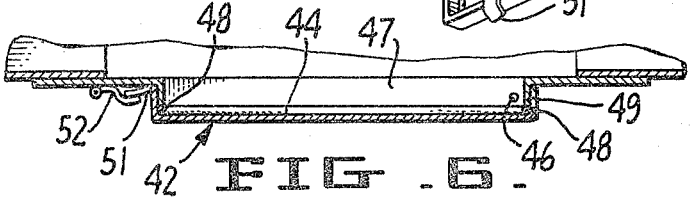
FIG. 6 is a longitudinal cross-sectional view through the rain gutter of FIG. 5 and illustrating the trap door in closed position.

FIG. 4 illustrates an end closure for a rain gutter trough 21A of substantially rectangular form. Because of the vertical outer wall 41, the bracket 32 shown in FIGS. 1 through 3 can be eliminated and the end closure member 26A can be hinged to outer wall 20A so as to swing laterally rather than vertically.

When large amounts of leaves or other debris accumulate in the rain gutter trough, breaking loose of large masses by use of the cleaning tool 27 and/or the jet of water from the garden hose nozzle can cause the vertical downspouts (not shown) to become plugged. To alleviate this situation, a trap door means 42 is provided.

As here shown, trap door means 42 is mounted in a trough section 43 formed for insertion into a rain gutter trough such as the trough 21A. A rectangular trap door member 44 is pivotally connected at 46 to a corresponding rectangular opening 47 formed in the bottom of trough section 43. To avoid leakage, a gasket 48 around the periphery of trap door member 42 engages a downwardly extending flange 49 encircling the opening 47. A latch member 51 on the distal end of trap door 44 engages under a mating latch member 52 secured to the underside of trough section 43 to hold the trap door closed during normal use.

The apparatus of the present invention is also adapted for mounting at outside corners of the rain gutters so as to provide access to the interiors of the straight stretches proceeding from such corners.

Figure 8:
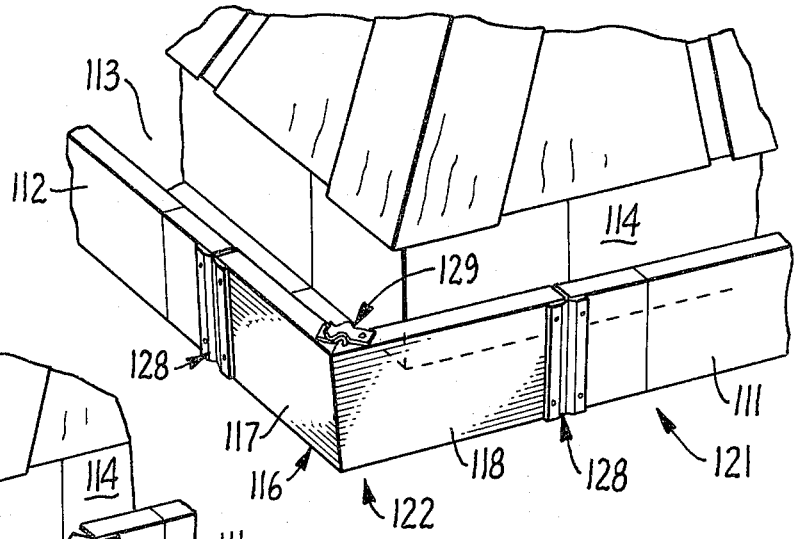
FIG. 8 is a fragmentary perspective view of a corner portion of a rain gutter trough mounted on the corner of a roof and illustrating the application of the present invention to such outside corner construction, the apparatus of the present invention being shown in normal position for catching and diverting rain water falling from the roof.
Figure 9:
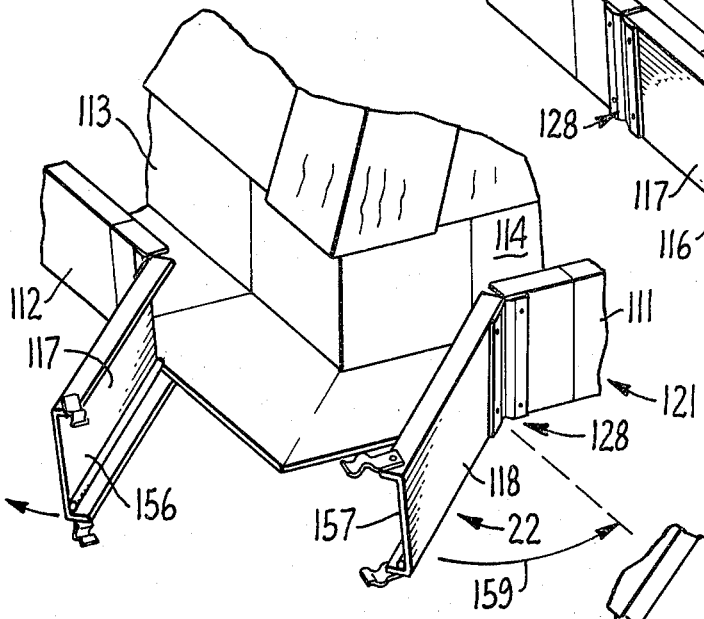
FIG. 9 is a fragmentary perspective view similar to that of FIG. 8, but illustrating the apparatus of the present invention in partially retracted position.

As shown in FIGS. 8 and 9 of the drawings, on rain gutter troughs 121 having flat, vertical side walls 111 and 112, the means 122 for providing access to the interiors 113 and 114 of the converging straight sections of the gutter troughs 121 comprises cutting out portions of the troughs 121 adjacent to the corner so as to provide access for cleaning tools and/or hose nozzles to each of the angularly related straight sections converging towards the corner.

A replacement corner section 116 is mounted on the open trough ends to complete the corner and replace the removed portions. Corner section 116 is provided with closure means in the form of a pair of closure members 117 and 118 formed for replacing the removed portions of the outer trough walls 111 and 112 when in their first, closed position illustrated in FIG. 8.

Hinge means 128 mount the closure means 117 and 118 to the rest of the replacement corner sections 116 to provide for selective swinging movement of the closure members 117 and 118 between the closed position illustrated in FIG. 8, wherein members 117 and 118 complete the trough side walls 111 and 112, and an open position providing access for cleaning tools, hose nozzles, and the like to the interiors of the converging straight sections of the gutter trough 121. FIG. 9 illustrates the movement of the members 117 and 118 from the closed position of FIG. 8 to the described open position, the previously abutting distal ends 156 and 157 of members 117 and 118 swinging outwardly as indicated by arrows 158 and 159, respectively. Suitable latch means 129 is provided on the confronting ends of members 117 and 118 to hold these members in the closed position during periods of normal use.

Figure 10:
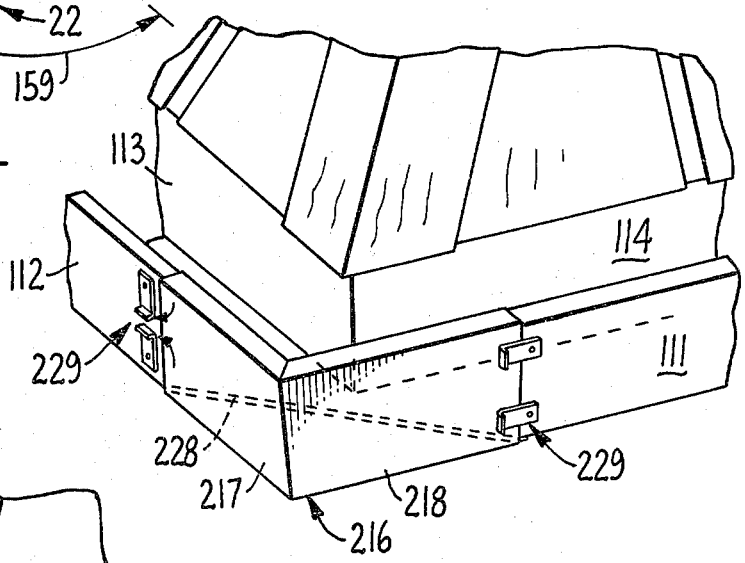
FIG. 10 is a fragmentary perspective view similar to that of FIG. 8, but illustrating a modified form of the invention in its normal operating position.
Figure 11:
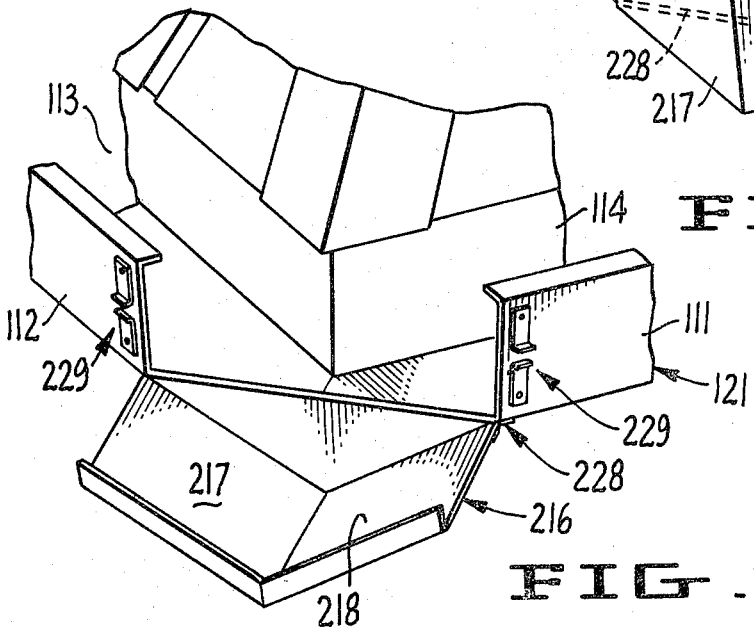
FIG. 11 is a fragmentary perspective view similar to that of FIG. 10, but illustrating the apparatus of the present invention in its opened position permitting access of cleaning tools to the straight sections of rain gutter proceeding from the corner.

In the form of the invention illustrated in FIGS. 10 and 11, the corner portion of gutter troughs 121 is eliminated and a replacement corner section 216 is mounted in place thereof. The floor portions of the straight stretches of trough 121 are cut away on the diagonal in the manner shown, and corner section 216 is formed accordingly. When the triangular corner section 216 is in the closed position illustrated in FIG. 10 of the drawings, its upstanding walls 217 and 218 provide continuations of the outside walls 111 and 112 of gutter trough 121 in the manner illustrated. Corner section 216 is carried on hinge means 228 so that the section 216 can swing downwardly out of the way, as illustrated in FIG. 11 of the drawings, and thus provide access to the interiors 113 and 114 of the converging straight stretches of gutter trough 121.

Figure 7:
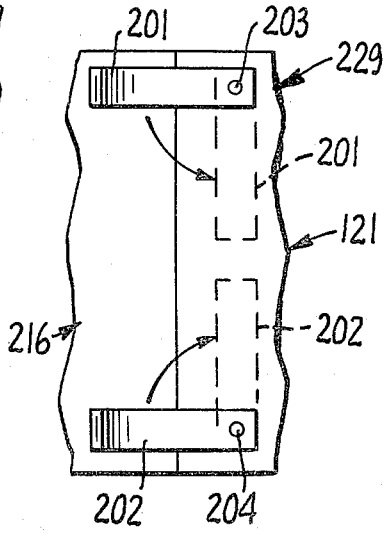
FIG. 7 is an enlarged fragmentary side elevational view of confronting portions of the rain trough and movable wall section and illustrating a latch device for selectively securing the removable section in normal operating position.

As here shown, section 216 is held in its closed position, FIG. 10, by latch means 229. As may best be seen in FIG. 7 of the drawings, the latch means 229 includes elongated strips 201 and 202 having one end pivotally mounted by pins 203 and 204 secured at the ends of trough sidewalls 111 and 112. Members 201 and 202 are normally in the position illustrated in solid lines in FIG. 7 of the drawings, holding section 216 from swinging outwardly and downwardly. When it is desired to move section 216 to the open position illustrated in FIG. 11 of the drawings, members 201 and 202 are simply swung to the retracted positions illustrated in phantom lines in FIG. 7.

From the foregoing, it will be seen that the rain gutter construction of the present invention provides a simple, sturdy and weatherproof structure well adapted for providing access to the interior of straight stretches of rain gutters by elongated prodding tools and/or water jets emanating from nozzles, with the structure being easily manipulated and used from a distance.

What is claimed is:

1. A rain gutter construction comprising a straight length of gutter formed for mounting along and under the eaves of a building, and means providing access to the interior of said straight length of gutter from an end thereof, said means comprising a member mounted for selective movement between a first position forming part of the gutter for retaining water therein and a second position permitting access to the interior of said straight length of gutter by an elongated cleaning tool.

2. A rain gutter construction as set forth in claim 1, and wherein said member is hingedly mounted on said gutter, and latch means is provided for releasably securing said member in said first position.

3. A rain gutter construction as set forth in claim 2, and wherein said member provides an end member formed for retaining rain water in said gutter when in said first position.

4. A rain gutter construction as set forth in claim 2, and wherein said member comprises a corner section connecting angularly related straight sections of rain gutter.

5. A rain gutter construction as set forth in claim 4, and wherein said corner section has members providing access to the interiors of both of said angularly related straight sections of rain gutter when said corner section member is in said second position.

6. A rain gutter construction as set forth in claim 5, and wherein said gutter is further provided with a trap door in the bottom thereof swingable between a closed position forming part of said bottom and an open position permitting drainage and insertion of cleaning tools.

7. In an open trough rain gutter having a straight section terminating in an open end, access structure comprising a closure member adapted for mounting at said open end and formed for damming off said end when in a first position, hinge means on said closure member adapted for attachment to said open end of said rain gutter, said hinge means being formed to provide for selective swinging movement of said closure member between said first position and a second position providing access to said rain gutter through said open end, and latch means for releasably holding said closure member in said first position.

8. An open trough rain gutter as set forth in claim 7, and wherein said hinge means extends across the top of said open trough rain gutter at said end, and said closure member is swingable thereon upwardly from said first position to said second position.

9. An open trough rain gutter as set forth in claim 7, and wherein said hinge means extends down a side of said open trough rain gutter at said end, and said closure member is swingable thereon laterally from said first position to said second position.

10. An open trough rain gutter as set forth in claim 7, and wherein said hinges are formed of polypropylene.

11. In an open trough rain gutter having angularly related straight sections providing an outside corner, access structure comprising closure means adapted for mounting at an outside corner in which portions of the outer wall of the open trough gutter have been removed to provide horizontal access to each of the angularly related straight sections, said closure means being formed for replacing the removed portions when in a first position, hinge means on said closure means adapted for attachment to said outer walls of said rain gutter, said hinge means being formed to provide for selective swinging movement of said closure means between said first position and a second position providing horizontal access to said straight sections of said rain gutter, and latch means for releasably holding said closure means in said first position.

12. An open trough rain gutter as set forth in claim 11, and wherein the floor of said open trough rain gutter is cut off diagonally from the remaining portion of one wall to the remaining portion of the other, said hinge means is mounted along the diagonal cut off edge of the rain trough floor, and said closure means is formed in substantially the same configuration as said cut off portion whereby said closure means replaces the removed floor and wall portions at said corner when in said first position and swings downwardly out of the way when in said second position.

13. An open trough rain gutter as set forth in claim 11, and wherein the portions of the outer wall at said corner are removed, said closure means provides a plurality of wall members formed for replacing the removed portions when in said first position, and said hinge means extends vertically along the juncture between said wall members and said rain gutter wall, and said latch means is formed for releasably securing said wall members together at the corner whereby upon release of said latch means said wall members may be swung laterally between said first and second positions.

* * * * *